US005789998A

United States Patent [19]

Kim et al.

[11] Patent Number: 5,789,998

[45] Date of Patent: Aug. 4, 1998

[54] DUPLEX DIELECTRIC FILTER

[75] Inventors: Nam Chul Kim, Kyongki-do; Young Jeong, Seoul, both of Rep. of Korea

[73] Assignee: Samsung Electro-Mechanics Co., Ltd., Kyongki-do, Rep. of Korea

[21] Appl. No.: 739,014

[22] Filed: Oct. 28, 1996

[30] Foreign Application Priority Data

Dec. 27, 1995 [KR] Rep. of Korea ..... 1995-58510

[51] Int. Cl.[6] ..... H01P 1/213

[52] U.S. Cl. ..... 333/134; 333/206

[58] Field of Search ..... 333/126, 134, 333/206, 222

[56] References Cited

U.S. PATENT DOCUMENTS

| | | | |
|---|---|---|---|
| 5,081,435 | 1/1992 | Yorita | 333/206 |
| 5,379,012 | 1/1995 | Shimizu et al. | 333/206 |
| 5,486,799 | 1/1996 | Komazaki et al. | 333/134 |
| 5,563,560 | 10/1996 | Komatsu et al. | 333/206 |

FOREIGN PATENT DOCUMENTS

| | | | |
|---|---|---|---|
| 5-259706 | 10/1993 | Japan | 333/206 |
| 5-291803 | 11/1993 | Japan . | |
| 6-45804 | 2/1994 | Japan . | |
| 6-196903 | 7/1994 | Japan . | |
| 6-232605 | 8/1994 | Japan . | |
| 6-276006 | 9/1994 | Japan . | |

*Primary Examiner*—Paul Gensler

*Attorney, Agent, or Firm*—Lowe, Price, LeBlanc & Becker

[57] ABSTRACT

A duplex dielectric filter is disclosed in which plural elements of the filter are merged into a single element to thereby simplify the manufacturing process and product handling, and automatize assembly. The conventional three separate shunt capacitors are simplified into a single dielectric substrate. A brass shim which was conventionally inserted between the shunt capacitors and the dielectric substrate to adjust the height of the shunt capacitors is eliminated. A dielectric substrate having load capacitors is extended to substitute for the brass shim. A through hole is formed through electrode patterns which are formed on both sides of the dielectric substrate to connect an input terminal to the shunt capacitors.

6 Claims, 5 Drawing Sheets

DUPLEX DIELECTRIC FILTER

FIELD OF THE INVENTION

The present invention relates to a duplex dielectric filter which commonly shares one antenna in transmitting and receiving the data in a mobile communication system and the like.

DESCRIPTION OF THE PRIOR ART

Generally, in a wireless communication system, a duplexer is used so that one antenna can be used for transmission and receiving. The duplexer is a filter for separating transmitting and receiving radio waves, and includes a transmitting filter, a receiving filter and a matching circuit.

FIG. 1 illustrates the basic constitution of the duplexer. As shown in this drawing, the duplexer basically includes two band pass filters. In its function, radio waves (frequency $F_R$) which are absorbed into an antenna are received into a receiver, while transmission waves (frequency $F_T$) are transferred from a transmitter to the antenna.

The duplexer including a ceramic dielectric resonator is classified based on the used dielectric resonator into: a monoblock type consisting of a single ceramic dielectric resonator; and a coaxial resonator consisting of a plurality of unit dielectric resonators.

FIG. 2 illustrates a transmitting circuit of the antenna duplex.

The transmitting circuit includes: three shunt capacitors C1–C3 disposed between an input terminal and an antenna; load capacitors CS1 and CS2; inductors L1–L3; and three dielectric coaxial resonators R1–R3. Further, to an antenna terminals not only an antenna but also a receiving section are connected as shown in FIG. 1.

FIG. 3 illustrates the construction of an actual duplex dielectric filter as an equivalent circuit for the above described circuit.

This conventional duplex dielectric filter includes: a transmitting section 10 and a receiving section 12. The transmitting section includes: a PCB 17 printed with a certain metal pattern 18; load capacitors CS1 and CS2 formed on a dielectric substrate 16 shunt capacitors C1–C3; lead lines 14 extending from resonators R1–R3 connected to the shunt capacitors C1–C3; inductors L1–L3 connected respectively between a brass shim 15 and the chip capacitor CS1, between the chip capacitor CS1 and the chip capacitor CS2, and between the chip capacitor CS2 and the antenna, thereby constituting a transmitting section. The receiving section 12 includes: four resonators R4–R7, a dielectric substrate 19, and a chip capacitor.

However, in the conventional duplex dielectric filter, there are provided three shunt capacitors C1–C3. Further, in order to adjust the height of the shunt capacitors C2 and C3 which are disposed upon the dielectric substrate 16 (on which the load capacitors are formed), components have to be unnecessarily increased in size. Further, for handling them, the process becomes complicated.

In an attempt to overcome this disadvantage, Japanese Patent Application Laid-open No. Hei-6-45804 proposes as follows. That is, on the PCB on which dielectric coaxial resonators are installed, the L components and the C components are formed into electrode layer patterns, thereby replacing the conventional capacitors and inductors.

However, this Japanese invention forms an electrode layer phase pattern, and therefore, the manufacturing process is not precise. Consequently, the values are not accurate, and the products are not uniform.

SUMMARY OF THE INVENTION

The present invention is intended to overcome the above described disadvantages of the conventional techniques.

Therefore it is an object of the present invention to provide a duplex dielectric filter in which several elements of the duplex dielectric filter are merged into a single one, thereby simplifying the manufacturing process and handling of the products, making it possible to automatize assembly.

It is another object of the present invention to provide a duplex dielectric filter in which the capacitors of the duplex dielectric filter are precisely manufactured, so as to reduce the errors of the filter.

In achieving the above objects, the present invention is characterized in that: the conventional three separate shunt capacitors are simplified into a single dielectric substrate; the brass shim which was conventionally inserted between the shunt capacitors and the dielectric substrate in order to adjust the height of the shunt capacitors is eliminated; a dielectric substrate having load capacitors is extended so as to substitute the brass shim; and a through hole is formed through electrode patterns formed on both sides of the dielectric substrate so as to connect an input terminal to the shunt capacitors.

BRIEF DESCRIPTION OF THE DRAWINGS

The above objects and other advantages of the present invention will become more apparent by describing in detail the preferred embodiment of the present invention with reference to the attached drawings in which.

DETAILED DESCRIPTION OF THE PREFERRED EMBODIMENT

Figure 4:
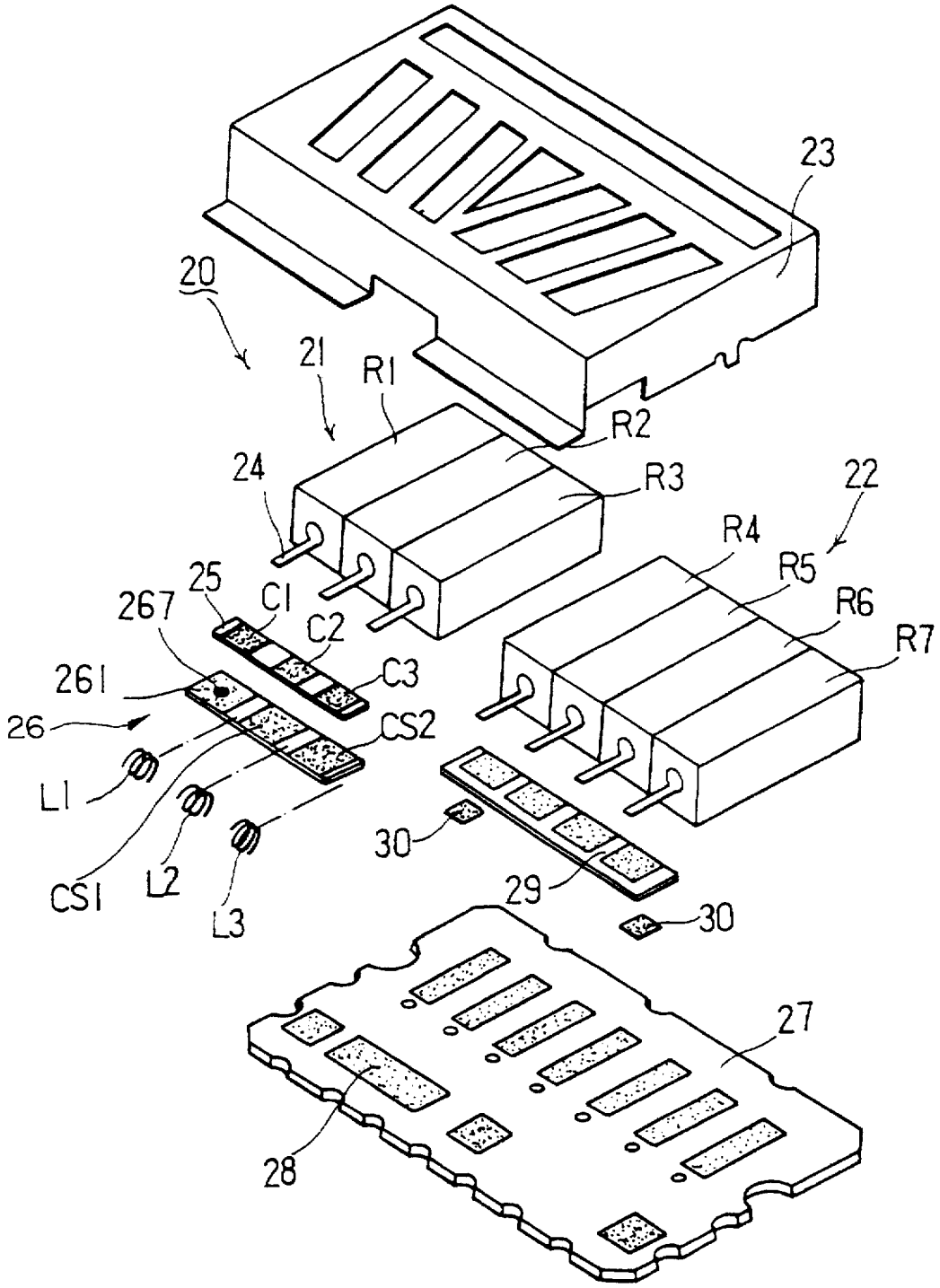
FIG. 4 illustrates an embodiment of the duplex dielectric filter according to the present invention.

FIG. 4 illustrates an embodiment of the duplex dielectric filter according to the present invention;

A duplex dielectric filter 20 according to the present invention includes: a PCB (printed circuit board) substrate 27 with a metallic conductive circuit pattern 28 formed on the upper face thereof; a receiving section 22 including a plurality of receiving section resonators R4–R7 and a transmitting section 21 including a plurality of transmitting section resonators R1–R3 attached on the circuit pattern 28 of the PCB substrate 27 by means of a conductive adhesive (e.g., soldering), and arranged side by side; a shunt capacitor substrate 25 with shunt capacitors C1–C3 formed integrally therewith, the shunt capacitors being connected through connecting rods 24 to internal conductors of the transmitting section resonators R1–R3; a load capacitor substrate 26 formed under the shunt capacitor substrate 25, with load capacitors CS1 and CS2 formed thereon, and with a pattern 261 (connected to an input terminal) formed thereon; inductors L1, L2 and L3 respectively connected between the input terminal pattern 261 and the load capacitor CS1, between the load capacitor CS1 and the load capacitor CS2, and between the load capacitor CS2 and an output terminal (not shown in the drawing); a receiving section capacitor substrate 29 with receiving section capacitors (reference codes not assigned) integrally formed therewith, the receiving section capacitors being connected to internal conductors of the receiving section resonators R4–R7; a pair of brass shims 30 disposed under an electrode pattern of the capacitors of the both ends of the receiving section capacitor substrate 29, and connected to the pattern of the PCB substrate 27; and a protecting case 23 having a rectangular shape smaller than that of the PCB substrate 27, and the bottom being open so as to protect the elements.

Figure 5:
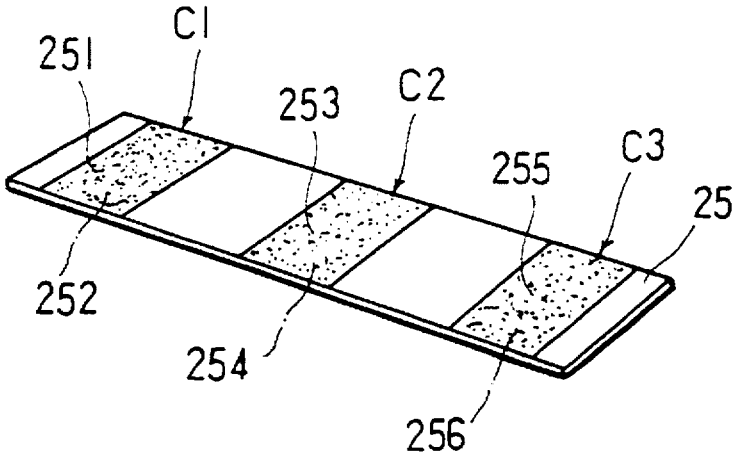
FIG. 5 illustrates an embodiment of the shunt capacitor substrate adopted in the present invention.

FIG. 5 illustrates an embodiment of the shunt capacitor substrate adopted in the present invention.

Figure 1:
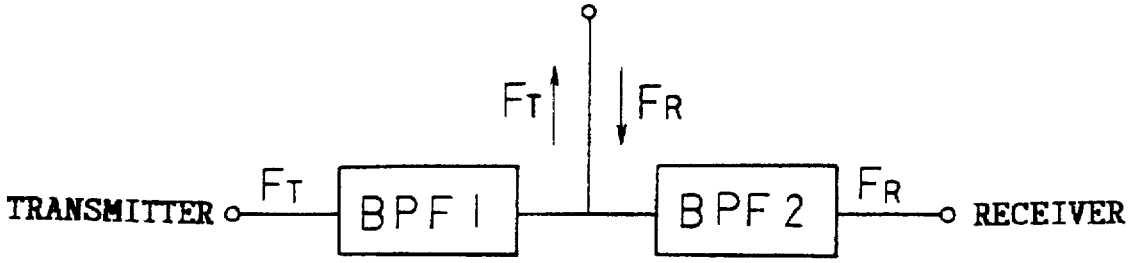
FIG. 1 illustrates the basic constitution of a duplexer.
Figure 2:
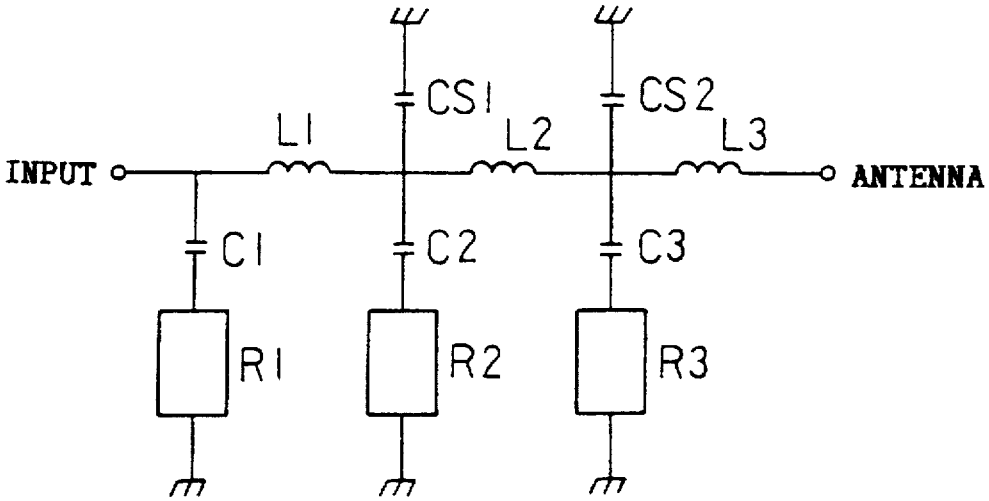
FIG. 2 illustrates the circuit of the transmitting section of an antenna duplexer.
Figure 3:
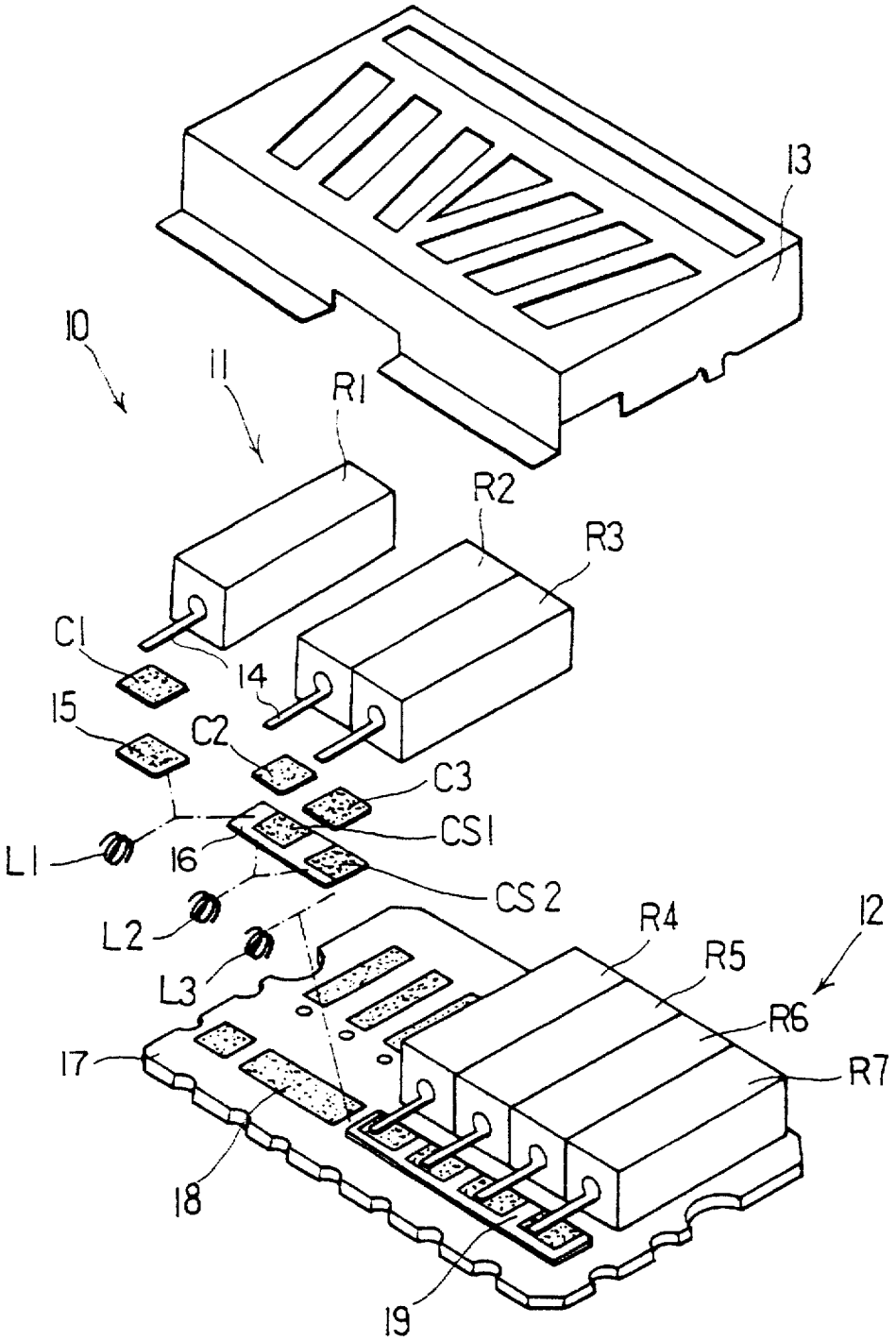
FIG.3 PRIOR ART
FIG. 3 illustrates the constitution of the conventional duplex dielectric filter.

Upon the shunt capacitor substrate 25 according to the present invention, there are formed electrodes 251–256 of the shunt capacitors C1–C3. The shunt capacitor C1 includes: electrodes 251 and 252 constituting conductive patterns on the upper and lower faces of the substrate 25; and the substrate 25 made of a dielectric material. That is, the conductive patterns 251 and 252 form the electrodes of a planar capacitor. The substrate 25 becomes a dielectric medium between the electrodes. The conductive pattern 251 is connected through connecting rod 24 (FIG. 4) to an internal conductor of the resonator R1, and therefore, it becomes a lower electrode of the capacitor C1 of the equivalent circuit of FIG. 2.

In the same way, the shunt capacitors C2 and C3 are planar capacitors which are formed in the above described manner. The shunt capacitor C2 consists of: electrodes 253 and 254 forming conductive patterns on the substrate 25; and the substrate 25 made of a dielectric material. The shunt capacitor C3 consists of: electrodes 255 and 256 forming conductive patterns on the substrate 25; and the substrate 25 made of a dielectric material.

Figure 6:
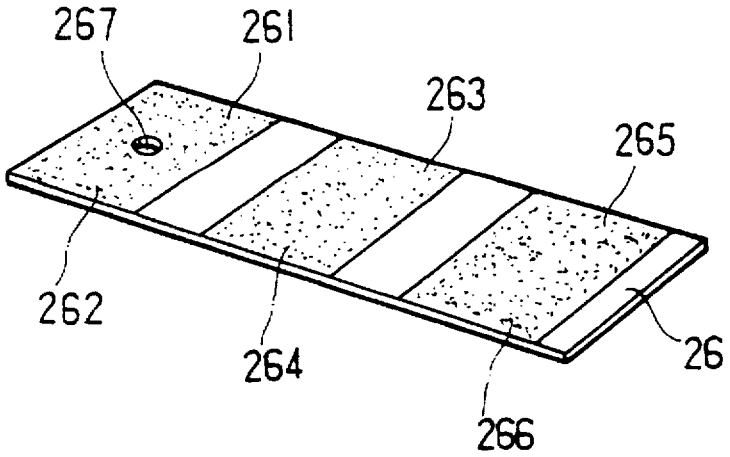
FIG. 6 illustrates an embodiment of the load capacitor substrate adopted in the present invention.

FIG. 6 illustrates an embodiment of the load capacitor substrate adopted in the present invention.

On the upper and lower faces of the load capacitor substrate 26 according to the present invention, there are formed electrodes 263–266 of the load capacitors CS1 and CS2. The load capacitor CS1 consists of: an electrode 263 forming a conductive pattern on the upper face of the substrate 26; the substrate 26 made of a dielectric material; and another electrode pattern 264 formed on the bottom of the load capacitor substrate 26. That is, the conductive patterns 263 and 264 are electrode plates of planar capacitors. The substrate 26 becomes a dielectric medium inserted between the electrodes. In the same way, the load capacitor CS2 consists of: an electrode 265 forming a conductive pattern on the upper face of the substrate 26; the substrate 26 made of a dielectric material; and another electrode pattern 266 formed on the bottom of the load capacitor substrate 26.

In contrast to the load capacitor patterns 263–266, the conductive patterns 261 and 262 which are formed on the left part of the substrate 26 are connected together through a through hole, and therefore, they do not have any capacitance. That is, these conductive patterns 261 and 262 serve as conductive lines connecting an input terminal of the duplex dielectric filter and the electrode pattern 252 of the shunt capacitor C1 together.

Figure 7:
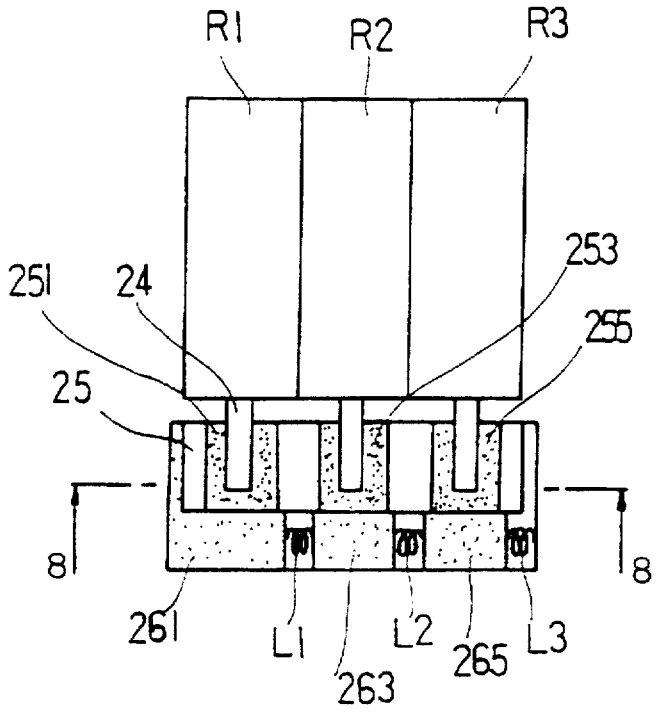
FIG. 7 is a plan view of the transmitting section in which a shunt capacitor substrate, a load capacitor substrate, and inductors are assembled.
Figure 8:
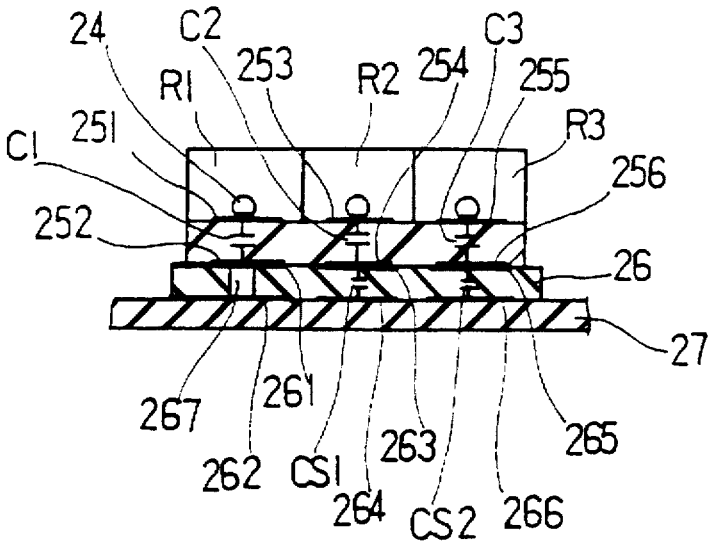
FIG. 8 is a sectional view taken along a line 8—8 of FIG. 7.

FIG. 7 is a plan view of the transmitting section in which a shunt capacitor substrate, a load capacitor substrate, and inductors are assembled. FIG. 8 is a sectional view taken along a line 8—8 of FIG. 7.

The shunt capacitor substrate 25 is attached to the load capacitor substrate 26 by means of a conductive adhesive (e.g., soldering). Thus, the conductive patterns 251 and 252 are positioned within the region of the conductive pattern 261 which is connected to the input terminal. Further, the conductive patterns 253 and 254 are positioned within the region of the conductive pattern 263 forming the load capacitor CS1. Further, the conductive patterns 255 and 256 are positioned within the region of the conductive pattern 265 forming the load capacitor CS2. The input terminal pattern 262 which is formed on the upper face of the PCB 27 is connected through the through hole 267 to the terminal 252 of the shunt capacitor C1, so that signals inputted from the external can be supplied to the shunt capacitor C1. The signals which have passed through the shunt capacitor C1 are supplied through the connecting rod 24 to the internal conductor of the resonator R1. Thus, the signals are resonated with the inherent frequency of the resonator R1, and then, are supplied through the inductor L1 to a filter circuit of the next stage. (The filter circuit of the next stage includes the inductor L1, the resonator R2, the shunt capacitor C2 and the load capacitor CS1.)

The signals which have passed through the inductor L1 are supplied through the shunt capacitor C2 and the connecting rod 24 to the internal conductor of the resonator R2 so as to be resonated with the inherent frequency of the resonator R2, and so as to be filtered by the load capacitor CS1. Then the signals are supplied through the inductor L2 to a filter circuit of the next stage. (The filter circuit of the next stage includes the inductor L2, the resonator R3, the shunt capacitor C3 and the load capacitor CS2.)

In a similar manner, the signals which have passed through the inductor L2 are supplied through the shunt capacitor C3 and the connecting rod 24 to the resonator R3 so as to be resonated, and so as to be filtered by the load capacitor CS2. Then the signals are supplied through the inductor L3 to the antenna so as to be radiated into the air.

As described above, the shunt capacitors C1–C3 which have been conventionally assembled as three separate elements are formed on a single substrate so as to form a single element. Further, the brass shim 15 which has been conventionally used to adjust the height of the shunt capacitor C1 is eliminated. Instead, an extension of the load capacitor substrate 16 on which the load capacitors CS1 and CS2 are formed replaces the brass shim. In this context, the conductive patterns 261 and 262 of the shunt capacitor C1 are connected together by a through hole, so that a capacitance would not be formed on the substrate 16 (which replaces the brass shim 15).

According to the present invention as described above, the number of the elements of the duplex dielectric filter is reduced. Consequently, an assembling automation becomes possible, and the assembling and material handling processes are simplified, with the result that the productivity is improved. Further, the errors are reduced, thereby making it possible to improve the product quality.

What is claimed is:

1. A duplex dielectric filter including a receiving section filter and a transmitting section filter for separating receipt and transmission radio waves by commonly sharing an antenna for receiving and transmitting signals, said transmitting section filter comprising:

a PCB substrate with a metallic conductive circuit pattern formed on the upper face thereof;

a plurality of transmitting section resonators attached on said circuit pattern of said PCB substrate by means of a conductive adhesive, and arranged side by side;

a shunt capacitor substrate with shunt capacitors formed integrally therewith, said shunt capacitors being connected through connecting rods to internal conductors of said transmitting section resonators;

a load capacitor substrate formed under said shunt capacitor substrate, with first and second load capacitors formed thereon, and with an input terminal pattern connected to an input terminal formed thereon; and a plurality of inductors respectively connected between said input terminal pattern and said first load capacitor, between said first load capacitor and said second load capacitor, and between said second load capacitor and an output terminal.

2. The duplex dielectric filter as claimed in claim 1, wherein said shunt capacitors comprise: electrodes constituting conductive patterns on upper and lower faces of said shunt capacitor substrate; and said shunt capacitor substrate made of a dielectric material.

3. The duplex dielectric filter as claimed in claim 1, wherein said load capacitors comprise: electrodes constituting conductive patterns on upper and lower faces of a load capacitor substrate; and said load capacitor substrate made of a dielectric material.

4. The duplex dielectric filter as claimed in claim 1, wherein:

said shunt capacitors and said inductors are disposed on said load capacitor substrate;

said shunt capacitor electrodes being formed of conductive patterns disposed within a region of electrode conductive patterns of said load capacitors; and said inductors are connected to said electrode conductive patterns of said load capacitors.

5. The duplex dielectric filter as claimed in claim 1, wherein said load capacitor substrate is provided with conductive patterns formed on both faces thereof, and said conductive patterns are mutually electrically connected so as to serve as a conductive line for connecting an input terminal of said duplex dielectric filter to electrodes of said shunt capacitors.

6. The duplex dielectric filter as claimed in claim 5, wherein said conductive patterns serving as a conductive line by connecting the input terminal of said duplex dielectric filter to said electrodes of said shunt capacitors are connected together via a through hole.

* * * * *